US005570872A

United States Patent [19]

Inoue et al.

[11] Patent Number: 5,570,872

[45] Date of Patent: Nov. 5, 1996

[54] FREE-ROTATION CONTROL APPARATUS OF HOIST AND TRACTION MACHINE

[75] Inventors: Yoshitaka Inoue; Yoshiaki Okamoto; Yasuo Wada, all of Sayama, Japan

[73] Assignee: Elephant Chain Block Company Limited, Osaka, Japan

[21] Appl. No.: 305,345

[22] Filed: Sep. 13, 1994

[30] Foreign Application Priority Data

Oct. 5, 1993 [JP] Japan ..... 5-249546
Dec. 1, 1993 [JP] Japan ..... 5-301911

[51] Int. Cl.[6] ..... B66D 1/14

[52] U.S. Cl. ..... 254/350; 254/353; 254/357

[58] Field of Search ..... 254/350, 352, 254/353, 354, 357, 366, 369, 376, 217, 218, 346

[56] References Cited

U.S. PATENT DOCUMENTS 4,469,308 9/1984 Nakamura et al. ..... 254/350
4,483,519 11/1984 Nakamura ..... 254/350
4,512,555 4/1985 Nakamura ..... 254/353

FOREIGN PATENT DOCUMENTS 0533466 12/1993 European Pat. Off. .
0585091 9/1994 European Pat. Off. .
2196929 5/1988 United Kingdom .

*Primary Examiner*—John M. Jillions
*Attorney, Agent, or Firm*—Watson Cole Stevens Davis, P.L.L.C.

[57] ABSTRACT

In a hoist and traction machine including a free rotation control apparatus, a free-rotation spring 19, for urging an operating handle 18 toward a driving member 8 and also urging the driving member 8 in the brake releasing direction, is interposed between the driving member 8 and a stopper 17 provided on a driving shaft 5. When the operating handle 18 is pulled out, the driving member 8 is rotated to move away from a driven member 7 by a torsional urging force of the spring 19 and thereby a braking ratchet wheel 11 and braking plates 9, 10 is released. Engagement lugs 31 are then brought into resilient contact with free rotation surfaces 35 via an axial urging force of the spring 19 to maintain controlled free-rotation.

7 Claims, 7 Drawing Sheets

FREE-ROTATION CONTROL APPARATUS OF HOIST AND TRACTION MACHINE

BACKGROUND OF THE INVENTION

1. Field of the Invention

The present invention relates to a free-rotation control apparatus of a hoist and traction machine, and more particularly to a free-rotation control apparatus adapted to make it possible that a load sheave rotates freely by setting a mechanical brake of a hoist and traction machine to the inactivated state.

2. Description of Prior Art

Conventionally, for use in a hoist and traction machine there have been proposed various free-rotation control apparatus adapted to allow a load sheave to rotate freely so as to enable an operator to pull out and pull back a load chain rapidly. One of them is the following free-rotation control apparatus (refer to the Specification and the Drawings of Japanese Patent Application No. Hei 3(1991)- 241372) previously proposed by the applicant of this invention. This apparatus has a stopper disposed at an axial end of its driving shaft, an operating handle interposed between the stopper and a driving member threadably mounted to the driving shaft and interlocked with driving means such as an operating lever so as to be axially movable between a steady state position in which it is near to the driving member and a free-rotation position in which it is spaced apart therefrom and to be impossible to rotate relatively with respect to the driving shaft, and a resilient pushing member interposed between the operating handle and the stopper so as to urge the handle toward the driving member. In the lever-type hoist and traction machine, when the operating handle is pulled out to the free-rotation position and is made to turn in the hoist and traction direction under such a condition that the rotation of the driving member is blocked, the driving shaft is rotated, so that the driving member threadably mounted to the driving shaft can be moved back with respect to a lining plate of a mechanical brake. When an action of the mechanical brake is released by that moving back, the free-rotation control can be carried out and the operating handle can be brought into resilient contact with the driving member by a pushing force of the resilient pushing member under that condition so as to maintain the free-rotation controlling state.

In the free-rotation control apparatus having the above-mentioned construction, since the operating handle is brought into resilient contact with the driving member by the urging force of the resilient pushing member at the time of free-rotation controlling so as to restrain a relative rotation of the driving member with respect to the driving shaft and maintain the free-rotation control, when the load chain is pulled out and pulled back under the free-rotation control, advantageously it becomes possible to enlarge an input range of a traction force applied to the load chain and to carry out the free-rotation operation without requiring any skill. Especially, however, in the lever-type hoist and traction machine, when the free-rotation control is carried out, it is required to firstly pull out the operating handle, then turn it so as to release the brake under such a condition that the rotation of the driving member is blocked, in other words, under such a condition that a reverse rotation pawl (a returning pawl) of the actuating pawl member provided in the operating lever meshes with teeth of the driving member so as to block the rotation of the driving member in the lever-type hoist and traction machine, and finally return an actuating pawl member to the neutral position. Therefore, when a novice operator carries out the free-rotation control, it is apprehended that the operator operates erroneously, for example changes over the actuating pawl member not to the returning pawl but to the forwarding pawl, reverses the operating handle and so on. Further, if such erroneous operations are carried out, of course it becomes impossible to carry out the free-rotation control appropriately, that results in confusion and inconvenience.

SUMMARY OF THE INVENTION

It is an object of the present invention to provide a free-rotation control apparatus which enables an operator to carry out a free-rotation control by such a simple operation as to merely pull out an operating handle, makes an operability simpler and easier and avoids such an inconvenience that the free-rotation control becomes impossible due to an erroneous operation in a hoist and traction machine.

The invention as in one embodiment has such a feature that, in a free-rotation control apparatus adapted to allow a load sheave to rotate freely by inactivating a mechanical brake in a hoist and traction machine provided with the load sheave, a driving shaft which has a driven member and serves to drive the load sheave a driving member threadably mounted to the driving shaft, the mechanical brake interposed between the driving member and the driven member, and driving means for driving the driving member in the normal and reverse rotation directions, there are provided:

a) a stopper disposed at an axial end portion of the driving shaft;

b) an operating handle interposed between the stopper and the driving member so as to be axially movable between a first position in which it comes near to the driving member and a second position in which it is spaced apart therefrom and adapted not to rotate relatively with respect to the driving shaft;

c) a free-rotation assisting spring interposed between the stopper and the operating handle and serving to urge the operating handle toward the first position in which the handle comes near to the driving member to urge the driving member in the brake releasing direction and to rotate the driving member so as to release the brake when the operating handle is moved to the second position;

d) restrictive means interposed between the operating handle and the driving member and serving to restrict a relative rotation range of the driving member with respect to the driving shaft when the operating handle is located at the first position and to cancel the restriction when the handle is located at the second position; and e) free-rotation maintaining means serving to bring the operating handle into resilient contact with the driving member by an axial urging force of the spring so as to maintain the free-rotation control carried out by the operating handle when the handle is located at the second position. The invention as in another embodiment has such a feature that a first free-rotation assisting spring is interposed between the stopper and the operating handle so as to urge the handle toward the first position in which it is near to the driving member while besides the first spring, a second free-rotation assisting spring is interposed between the driving member and the operating handle so as to urge the driving member in the brake releasing direction. The invention as or yet another embodiment has such a feature that a free-rotation control surface is formed in such a surface of the driving member as to be opposed to the operating handle side, an engagement lug is protruded from such a surface of the operating handle as to be opposed to the driving member side so as to be brought into resilient contact with the free-rotation control surface by the urging force of the first spring when the operating handle is located in the second position, and the second free-rotation assisting spring for urging the driving member in the brake releasing direction is engaged with the engagement lug.

The invention as in yet another embodiment has a feature that the second spring comprises a coil portion formed spirally in a coplanarlity, a first spring leg located at one end of the coil portion so as to engage with the driving member and a second spring leg located at the other end thereof so as to engage with the engagement lug of the operating handle. The invention as set forth in embodiment has such a feature that the driving member is provided with an engagement portion which engages with the second spring so as to interrupt that the second spring urges the driving member in the brake releasing direction when the operating handle is located at the first position, and which cancels the engagement with the second spring when the operating handle is moved to the second position. Further, the invention as in yet another embodiment has such a feature that the driving means comprises an operating lever provided with an actuating pawl member adapted to disengagably engage with the driving member so that a spring force for urging the driving member in the brake releasing direction can be used as a spring force for rotating the driving member disengaged from the pawl member of the operating lever, to the brake releasing position when the operating handle is moved to the second position.

The invention as in yet another has a feature that the driving means comprises an operating lever provided with an actuating pawl member adapted to disengagably engage with the driving member, the operating lever has a boss portion provided with a protruded tube projecting toward the operating handle, the operating handle is provided with a cylindrical cover portion which covers the protruded tube and the protruded tube, is provided with a free-rotation indicating portion which appears for indication by the movement of the cover portion when the operating handle has been moved to the second position.

Since there is provided the free-rotation assisting spring, which urges the operating handle toward the first position in which the handle is near to the driving member and urges the driving member in the brake releasing direction, when the handle is pulled out to the second position so as to carry out the free-rotation control, the driving member can be rotated in the brake releasing direction with respect to the driving shaft by a torsional urging force of the spring in the brake releasing direction to make the mechanical brake released. Thereupon, the operating handle can be brought into resilient contact with the driving member by an axial urging force of the spring toward the first position to maintain the free-rotation control by the handle. Therefore, it becomes possible to enlarge an input range of a traction force of the load chain due to the maintaining of the free-rotation state by the spring at the time of free-rotation control. As a result, a length of the load chain can be adjusted without requiring any skill, and when the operating handle has been pulled out to the second position, since the mechanical brake can be released by rotating the driving member due to an effect of the spring, the free-rotation control can be carried out by merely pulling out the handle even though a novice operator carries out the free-rotation control. Accordingly, an operability can be made simple and easy, and erroneous operations can be avoided so as to improve the operability and dissolve such an inconvenience that the free-rotation control becomes impossible due to such erroneous operations.

Since there is provided the second spring besides the first spring these first and second springs, can be mounted separately respectively. Therefore, since their mountabilities can be improved in comparison with a case in which one spring serves a double purpose as well as also a spring characteristic can be selected according to a function of each spring the effects mentioned in the can be accomplished more effectively.

Since the second spring is adapted to engage with the engagement lug, the urging control for the second spring becomes possible due to a simple construction employing the engagement lug.

The second spring can be formed in a flat configuration. Therefore, the second spring can be mounted even into a small space between the driving member and the operating handle and can be applied also to such a machine as to have an overload preventive mechanism which will be explained in an embodiment of the invention later.

Since the driving member is provided with the engagement portion, when the operating handle is located at the first position, the first spring is engaged with the engagement portion of the driving member so that the driving member is not urged in the brake releasing direction while when the handle is moved to the second position, the engagement by the engagement portion is cancelled so as to urge the driving member in the brake releasing direction. Therefore, in addition to the functions mentioned above it becomes also possible to avoid a sudden release of the mechanical brake due to an effect of the second spring at the time of hoist and traction working carried out at the first position of the handle. That is, even though the actuating pawl member of the operating lever provided as the driving means is misoperated to a neutral position in the lever-type hoist and traction machine, the sudden release of the mechanical brake can be prevented.

In the lever-type hoist and traction machine, since the spring force for urging the driving member in the brake releasing direction is used as a spring force capable of rotating the driving member disengaged from the actuating pawl member of the operation lever to the brake released position when the operating handle has been pulled out to the second position, the free-rotation control can be carried out by merely pulling out the handle under such a condition that the actuating pawl member of the operating lever is set to the neutral position, namely the free-rotation position. Accordingly, it becomes unnecessary to carry out tedious operations such as turning the handle and returning the returning pawl of the actuating pawl member to the neutral position after having been made to engage with the driving member, so that the operability can be made simple and easy and the free-rotation position of the actuating pawl member can be indicated. Further, since the free-rotation control can be carried out by merely pulling out the handle, erroneous operations for not only the handle but also the actuating pawl member can be avoided so as to improve the operabilities. Furthermore, since the brake is released by rotating the driving member relative to the driving shaft by the spring force, the spring force can be made less than that required for rotating the driving shaft. Therefore, the returning from the free-rotation state to the steady state in which the brake is effected can be made smooth.

Further, when the free-rotation control is carried out after the operating handle has been moved to the second position, a cylindrical cover portion provided in the handle is moved following the movement of the handle, so that a free-rotation indicating portion provided on a protruded tube of the operating lever appears for indication. Therefore, it can be readily recognized from outside that the operating handle is located at the second position so that the lead sheave is situated in the free-rotation controllable condition. When the free-rotation indicating portion is covered by the cylindrical cover portion of the handle not to be observed from outside, it can be readily recognized that the handle is located at the first position and the load sheave is in the steady operating state. Accordingly, it becomes possible to avoid erroneous operations of operators.

The above and other objects, features and advantages of the present invention will become readily apparent from the following detailed description thereof which is to be read in connection with the accompanying drawings.

DETAILED DESCRIPTION OF PREFERRED EMBODIMENTS

Figure 1:
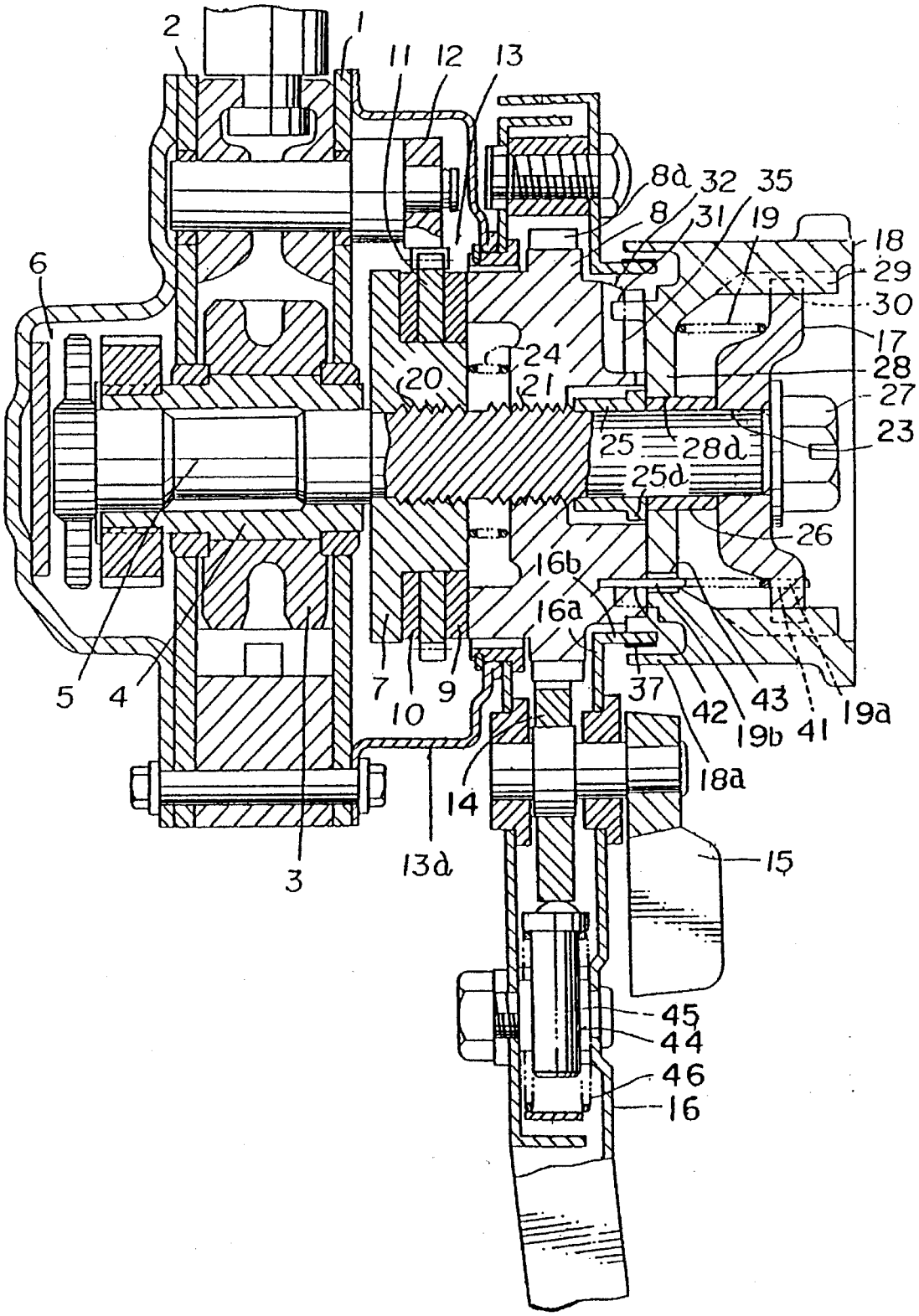
FIG. 1 is a vertical sectional view of a lever-type hoist and traction machine employing a first embodiment of a free-rotation control apparatus of the present invention.

In a lever-type hoist and traction machine according to an embodiment illustrated in FIG. 1, a cylindrical shaft 4 provided with a load sheave 3 is supported rotatably between a first and a second side plates 1, 2 opposed to each other through a predetermined distance. A driving shaft 5 to which a rotative power is transmitted from an operating lever side is supported within the cylindrical shaft 4 so as to be relatively rotatable. Between an outer end portion of the driving shaft 5 projected beyond the second side plate 2 and the load sheave 3 there is interposed a reduction gear mechanism 6 comprising a plurality of speed reducing gears so that the rotative power of the driving shaft 5 can be transmitted to the load sheave 3 in a speed reduced state through the reduction gear mechanism 6.

A driven member 7 comprising a hub provided with a flange is threadably mounted to an external side of the driving shaft 5 projected beyond the first side plate 1 A driving member 8 having teeth 8*a* formed along the external periphery is threadably mounted to an outside portion of the driving shaft 5 beyond the driven member 7. Between the driving member 8 and the driven member 7 there are interposed a pair of braking plates 9, 10 and a braking ratchet wheel 11 while a braking pawl 12 adapted to mesh with the braking ratchet wheel 11 is mounted to the first side plate 1, so that a mechanical brake 13 is constructed by these braking ratchet wheel 11 and braking plates 9, 10.

Further, in a location axially outside a brake cover 13*a* adapted to cover an external peripheral portion of the mechanical brake 13 and radially outside the driving member 8 there is provided driving means comprising an operating lever 16 provided with an actuating pawl member 14 having a forwarding pawl and a returning pawl adapted to mesh with the teeth 8*a* formed in the external peripheral portion of the driving member 8 and a controlling portion 15 adapted to be controlled so as to optionally make the forwarding pawl and the returning pawl of the actuating pawl member 14 mesh with the teeth 8*a* or disengage from the teeth 8*a*.

In the lever-type hoist and traction machine having the above-mentioned construction, a stopper 17 is disposed at an axial end portion of the driving shaft 5. Between the stopper 17 and the driving member 8 there is interposed an operating handle 18 which is incapable of relatively rotating with respect to the driving shaft 5 but capable of moving axially between a first position in which it comes near to the driving member 8 and a second position in which it is spaced apart therefrom. Between the operating handle 18 and the stopper 17 there is provided a free-rotation assisting spring 19 which serves to urge the handle 18 toward the driving member 8 and generally comprises a coil spring having a pair of spring legs 19*a*, 19*b* with one leg 19*a* engaged with the stopper 17 and the other leg 19*b* engaged with the driving member 8 and to urge the driving member 8 in the brake releasing direction. Between the operating handle 18 and the driving member 8 there is provided restrictive means which serves to restrict a relative rotation range of the driving member 8 with respect to the driving shaft 5 and to cancel the restriction by the movement of the operating handle 18 in the direction opposed to the driving member 8, namely by the movement thereof to the second position.

That is, in the embodiment illustrated in FIG. 1, first and second threaded portions 20, 21 and serrated portion 23 are formed in the driving shaft 5, so that the driven member 7 is threadably mounted to the first threaded portion 20 and the driving member 8 is threadably mounted to the second threaded portion 21 respectively, and further a coil spring 24 is interposed between the driven member 7 and the driving member 8 so that the axial movement of the driven member 7 with respect to the driving shaft 5 can be restrained by the coil spring 24 and the driving member 8 can be moved leftward in FIG. 1 by a normal rotation of the driving member 8 relative to the driving shaft 5. A pair of sleeves 25, 26 are fitted to the serrated portion 23 outside the driving member 8 with the first sleeve 25 provided with a flange 25*a* and the stopper 17 attached through a serration coupling to an end portion of the serrated portion 23 outside the second sleeve 26. The stopper 17 is fixedly secured to the driving shaft 5 through the sleeves 25, 26 by tightening a nut 27.

Figure 2:
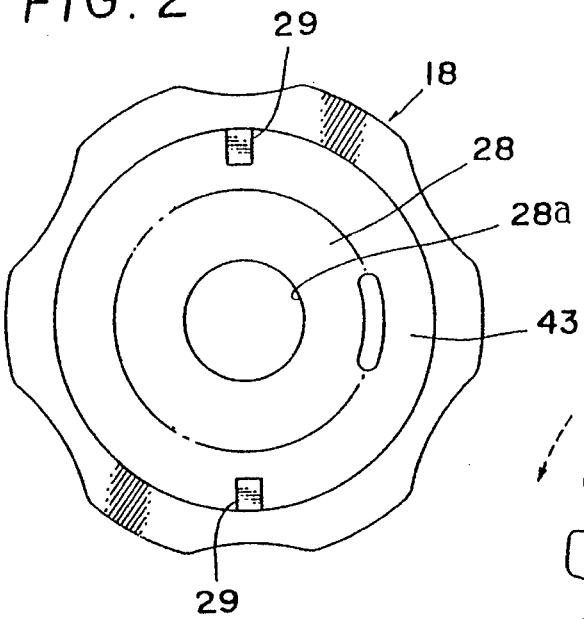
FIG. 2 is a front view of an operating handle thereof.
Figure 3:
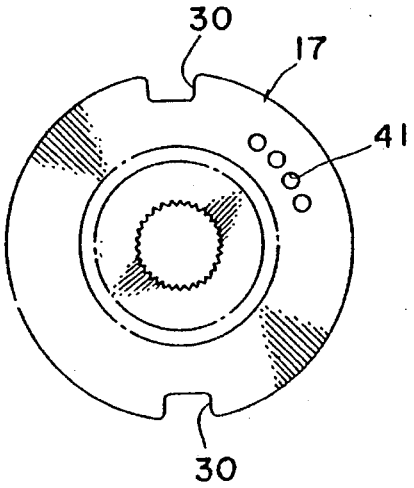
FIG. 3 is a front view of a stopper thereof.

The operating handle 18 is fitted onto the second sleeve through an fitting port 28*a* formed in a boss portion 28 thereof so as to allow the handle 18 to be axially moved along the driving shaft 5 and rotated between the stopper 17 and the driving member 8. As shown in FIG. 2, convex rails 29 are formed in an inner peripheral surface of the operating handle 18 and, as shown in FIG. 3, concave grooves 30 are formed in an outer peripheral portion of the stopper 17 so as to engage with the convex rails 29. The convex rails 29 of the operating handle 18 are made to engage with the concave grooves 30 of the stopper 17 so that the handle 18 can not be turned relatively with respect to the driving shaft 5.

Figure 6:
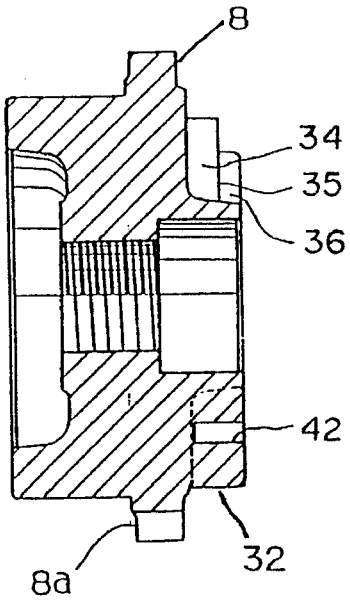
FIG. 6 is a sectional view taken along the A—A line in FIG. 4.

A free-rotation assisting spring 19 is interposed between the outside of the boss portion 28 of the operating handle 18 and the inside of the stopper 17 opposed to the boss portion 28. As shown in FIGS. 3 and 6, an engagement port 41 and an engagement hole 42 are formed in the stopper 17 and the driving member 8 respectively so as to engage with opposite legs 19*a*, 19*b* of the spring 19. An arcuate elongated port 43 is formed in the operating handle 18 so that a mid portion of the spring leg 19*b* to be engaged with the engagement hole 42 can pass therethrough. That is, the spring leg 19*b* passes through the elongated port 43 and then engages with the engagement hole 42 of the driving member 8. When the spring 19 is mounted between the stopper 17 and the operating handle 18 with its legs 19*a*, 19*b* engaged with the engagement port 41 and the engagement hole 42 respectively, the stopper 17 to be mounted onto the serrated portion 23 of the driving shaft 5 is coupled to the serrated portion 23 in such a twisted condition that the spring leg 19*a* to be engaged with the engagement port 41 of the stopper 17 is moved in the peripheral direction relative to the spring leg 19*b* to be engaged with the engagement hole 42 of the driving member 8 so that a reaction force of the spring 19 acts on the driving member 8 in the brake releasing direction, namely in the direction of a dotted arrow in FIG. 4. Under this condition, the driving member 8 is urged by the spring 19 in the brake releasing direction, so that the mechanical brake 13 can be released by selecting the spring force suitably at the time of free-rotation control which will be explained later. The coil portion of the spring 19 to be interposed between the stopper 17 and the operating handle 18 is adapted to be brought into contact with the inside of the stopper 17 and the outside of the boss portion 28 of the handle 18 when the stopper 17 is fixedly secured to the driving shaft 5 by the nut 27. The coil portion deforms axially due to that contact, so that the operating handle 18 is urged so as to be pushed onto the flange 25*a* of the first sleeve 25, that is, in the direction opposed to the stopper 17, namely toward the driving member 8.

Incidentally, as shown in FIG. 3, the plurality of engagement ports 41 are formed separately in the stopper 17 along the peripheral direction of the stopper 17 so that the leg 19*a* of the spring 19 can be engaged with a selected one of the ports 41. An adjustment of the torsional reaction force of the spring 19 becomes possible by the selection of the engagement ports 41.

Figure 4:
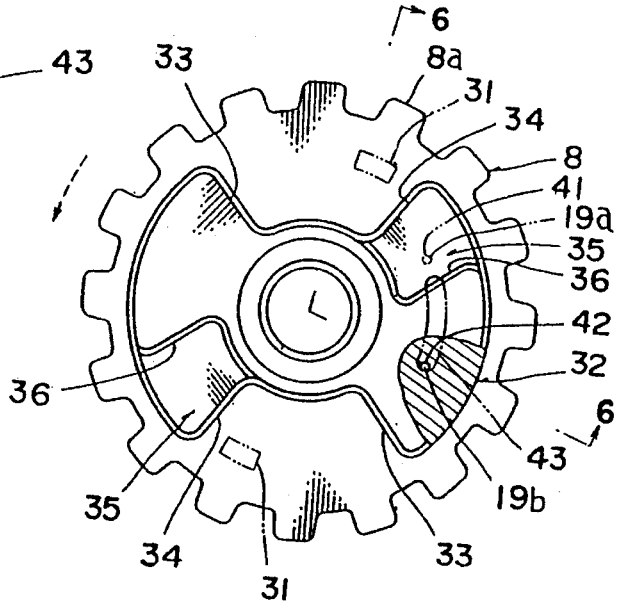
FIG. 4 is a front view showing positional relationships between a driving member, an engagement lug provided in the operating handle and a free-rotation assisting spring during a usual use.

Further, two engagement lugs 31 are formed symmetrically as indicated by the dotted line in FIG. 4 in the radial marginal portion of the back side of the boss portion 28 of the operating handle 18 so as to project toward the driving member 8. As illustrated in FIGS. 1 through 4, a pair of protruded portions 32 are formed symmetrically in the side of the driving member 8 opposed to the boss portion 28 of the operating handle 18. The protruded portions 32 have restrictive means comprising first and second respective surfaces 33, 34 with which the engagement lugs 31 engage so as to restrict the relative rotational range of the driving member 8 with respect to the driving shaft 5, when the driving member 8 rotates relatively with respect to the driving shaft 5. Also, there are provided free-rotation control surfaces 35 constructing the free-rotation maintaining means which are in connection to the second restrictive surfaces 34 and serve to maintain the free-rotation together with the engagement lugs 31 by being brought into contact with the leading end surfaces of the lugs 31 by the axial urging force of the spring 19 when the operating handle 18 is moved to the second position opposed to the driving member 8 so as to rotate the driving member 8 relatively with respect to the driving shaft 5 by the urging force of the spring 19 in the torsional direction thereof. Further, the protruded portion 32 is provided with a restrictive portion which is raised from the free-rotation control surface 35 and has a third restrictive surface 36 adapted to engage with a front side of the engagement lug 31 in the rotational direction thereof when the driving member 8 rotates relatively with respect to the driving shaft 5 under such a condition that the leading end surface of the lug 31 is kept in contact with the free-rotation control surface 35.

Incidentally, the symbol 44 in FIG. 1 designates a pawl holding mechanism which serves to hold the actuating pawl member 14 optionally at the forwarding position (the normal rotation position) in which the forwarding pawl thereof engages with the teeth 8*a* of the driving member 8, at the returning position (the reverse rotation position) in which the returning pawl thereof engages with the teeth 8*a* and at the neutral position in which neither of the forwarding pawl and the returning pawl engages with the teeth 8*a* and comprises a pushing member 45 and a spring 46. Indications for indicating the operational positions of the controlling portion 15 of the actuating pawl member 14, for example such as "Forwarding", "Returning" and "Neutral" or "Free-Rotation" are provided on the outer surface of the operating lever 16.

The operating lever 16 has a protruded tube 16*b* formed integrally in the boss portion 16*a* so as to project toward the operating handle 18 to externally surround both the protruded portions 32 provided with the free-rotation control surface 35 and the engagement lugs 31 projected from the operating handle 18. On the outer surface of the protruded tube 16*b* there is provided a free-rotation indicating portion 37 having directly printed letters, symbols and the like which indicate the free-rotation control conditions or a pasted seal material printed with those letters and the like. On one hand, the operating handle 18 has a cylindrical cover portion 18*a* so integrally formed in the outer peripheral portion thereof as to project toward the operating lever 16 and so located as to externally surround the protruded tube 16*b* in an overlapped manner. When the free-rotation control is carried out by the operating handle 18 being moved to the second position, the cylindrical cover portion 18*a* is moved following the operational movement of the handle 18, so that the free-rotation indicating portion 37 provided on the protruded tube 16*b* appears for indication and it can be readily recognized from outside that the operating handle 18 is located at the second position and the load sheave 3 is under the free-rotation controllable condition.

In the above construction, the formation of the first and the second threaded portions 20, 21 and the the threadable mounting of the driven member 7 and the driving member 8 therewith have been done in consideration of workability and strength of the driving shaft 5. But, the first threaded portion 20 may be replaced with a serration. When the first threaded portion 20 is formed and the driven member 7 is threadably mounted thereto, the screw movement of the driven member 7 is so devised as to be restrained by the coil spring 24. But, an E-ring may be provided in the second threaded portion 21 so that the coil spring 24 may be interposed between the E-ring and the driven member 7. Further, the screw grooves of the first threaded portion 20 may be coated with such a nylon resin produced by Nylock Co., Ltd. in USA as to have a large elastic reaction force and a frictional connecting force so that the screw movement of the driven member 7 may be restrained by a non-return effect of the coating. Furthermore, since the driven member 7 may be fixedly secured to the driving shaft 5 by screwing a stop bolt or hammering a cotter pin thereinto, the spring 24 is not always necessary.

Then, a function of the lever-type hoist and traction machine having the above-mentioned construction will be explained hereinafter.

Firstly, when hoisting a load, the forwarding pawl of the actuating pawl member 14 is made to mesh with the teeth **8*a* of the driving member 8 by operating the controlling portion 15 of the operating lever 16. Then, the lever 16 is reciprocatively swung so as to rotate the driving member 8 in the normal rotating direction. During the normal rotation, the driving member 8 moves due to a screw effect leftward in FIG. 1, namely toward the driven member 7, so that the mechanical brake 13 is effected. Thereupon, the rotative power of the driving member 8 is transmitted from the driving shaft 5 to the load sheave 3 through the reduction gear mechanism 6 and the cylindrical shaft 4 to rotate the load sheave 3 so as to hoist the load by utilizing a chain looped around the load sheave 3**.

When lowering the load, the returning pawl of the actuating pawl member 14 is made to mesh with the teeth **8*a* of the driving member 8 by operating the controlling portion 15. Then, the lever 16 is reciprocatively swung so as to rotate the driving member 8 in the reverse rotating direction. Thereupon, since the engagement lugs 31 are located at the position indicated by the dotted lines in FIG. 4, namely between the first restrictive surface 33 and the second restrictive surface 34, the driving member 8 rotates relatively with respect to the driving shaft 5 between the first restrictive surface 33 and the second restrictive surface 34 to move back with respect to the driven member 7. The braking action of the mechanical brake 13 is stopped by the back movement of the driving member 8, so that the driving shaft 5 can rotate reversely by a number of reverse rotations of the driving member 8**, that makes it possible to carry out the load lowering in safety.

Next, it will be explained hereinafter that the chain looped around the load sheave 3 is extended or contracted freely with respect to the load side under the free-rotation condition of the load sheave 3.

Figure 5:
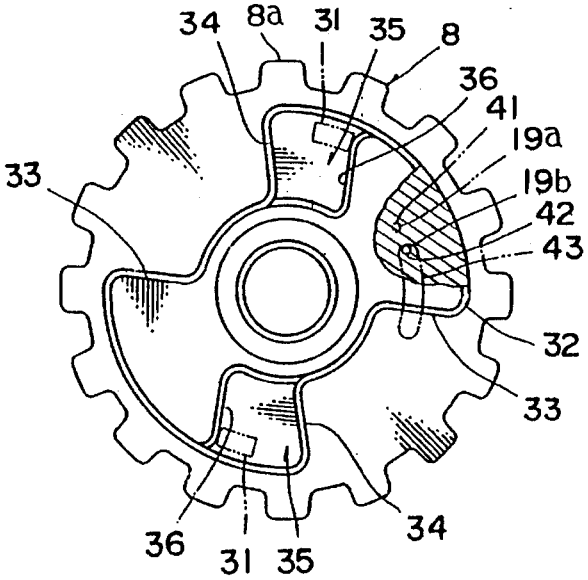
FIG. 5 is a front view showing positional relationships therebetween during a free-rotation control, correspondingly to FIG. 4.

In this case, the actuating pawl member 14 is made to take the neutral position and then the operating handle 18 is pulled out toward the stopper 17, namely to the second position opposed to the driving member 8 against an axial urging force of the spring 19. The lugs 31 of the operating handle 18 are moved by that pulling out to the restriction cancelling position in which they are not restricted by the first and the second restrictive surfaces 33, 34. Thereupon, due to this cancellation of the restriction and the changeover of the actuating pawl member 14 to the neutral position, the driving member 8 is rotated in the brake releasing direction (the direction of the arrow depicted by the dotted line in FIG. 4) by the urging force of the spring 19 in the torsional direction thereof and brought into the state illustrated in FIG. 5.

Figure 7:
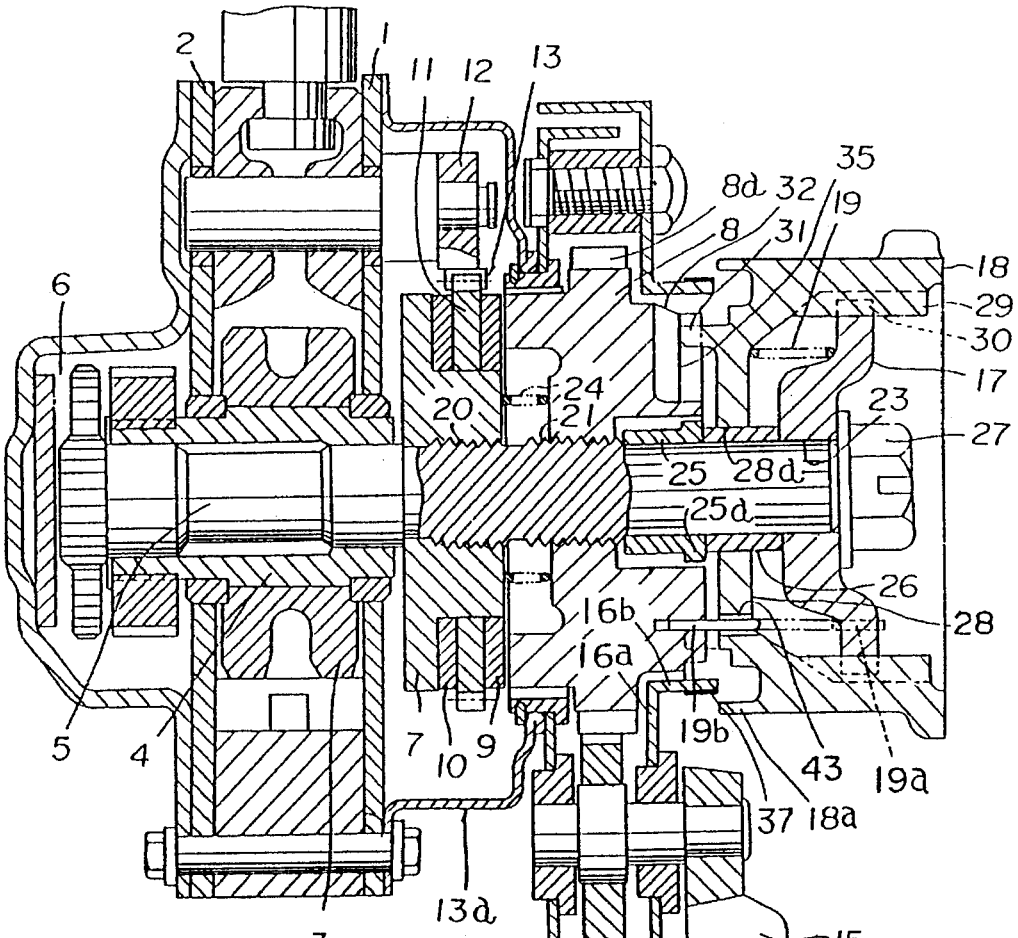
FIG. 7 is a vertical sectional view of the lever-type hoist and traction machine showing the free-rotation control state.

Accordingly, since the spring force of the spring 19 is used as a spring force capable of making the driving member 8 rotate to the brake releasing position at the neutral position of the actuating pawl member 14, the driving member 8 is rotated so as to move back due to the screw effect in the direction opposed to the driven member 7 by merely pulling out the operating handle 18 to the second position to cancel the braking effect of the mechanical brake 13 so that the load sheave 3 can be made to take the free-rotation state. Thereupon, the lugs 31 move from the position indicated by the dotted lines in FIG. 4 to the position indicated by the dotted lines in FIG. 5 to oppose to the free-rotation control surfaces 35 of the driving member 8. When the operating handle 18 is released from the pulling out operation under this condition, the operating handle 18 is pushed toward the driving member 8 by the axial urging force of the spring 19, so that the leading end surfaces of the lugs 31 are brought into resilient contact with free-rotation restrictive surfaces 35 of the protruded portions 32 provided in the driving member 8 as shown in FIG. 7 and the free-rotation state of the load sheave 3 can be maintained by a frictional resistance caused by that resilient contact. Accordingly, since the free-rotation state can be maintained in that way, an input range of the traction force of the chain can be enlarged in comparison with the conventional embodiment during the free-rotation control allowing the traction of the chain and the rapid extension and contraction of the load side chain, so that it becomes possible to adjust the extension and contraction of the chain on the load side without requiring any skill. Further, when the operating handle 18 is moved to the second position during the above-mentioned free-rotation control, a tubular cover portion **18*a* is moved following the movement of the handle 18, so that the free-rotation indicating portion 37 provided in the protruded tube 16*b* of the operating lever 13 appears so as to be observed from outside as shown in FIG. 7. Therefore, it can be readily recognized externally that the operating handle 18 is located in the second position and the load sheave 3 is in the free-rotation control state. When the free-rotation indicating portion 37 is covered by the tubular cover portion 18*a* of the handle 18 so as not to be observed from outside, it can be readily understood that the operating handle 18 is located at the first position and the load sheave 3 is in the steady running state wherein the load hoisting or lowering is carried out. Accordingly, it becomes possible to effectively avoid erroneous operations of the operator by making use of the indication portion 37**.

When the driving member 8 is rotated relatively with respect to the driving shaft 5 by the torsional urging force of the spring 19 under such a condition that the restrictive portions are provided in the protruded portions 32 of the driving member 8 and the leading end surfaces of the engagement lugs 31 are in resilient contact with the free-rotation control surfaces 35 of the protruded portions 32, the front portions of the engagement lugs 31 in the rotation direction is so restricted by third restrictive surfaces 36 of the restrictive portion as not to rotate any further than that relative rotation. Therefore, it is possible to restrict an angle of rotation of the driving member 8 caused by the spring 19, so that a space distance between the driving member 8 and the driven member 7 can be made not to become wider than a distance required for the free-rotation of the load sheave 3.

Further, when a traction force of the chain is increased under the above-mentioned free-rotation control so as to apply a strong reverse-direction force to the load sheave 3, the resilient contact between the leading end surfaces of the engagement lugs 31 and the free-rotation control surfaces 35 is cancelled due to slippage therebetween so that the engagement lugs 31 return between the first restrictive surface 33 and the second restrictive surface 34. Thereupon, as mentioned above, the engagement lugs 31 return to such a condition that the braking function of the mechanical brake 13 can be effected or interrupted optionally. That is, when the strong reverse-direction force is applied to the load sheave 3 under the free-rotation condition, since the driving member 8 is threadably mounted to the driving shaft 5 and a rotative inertia force thereof is larger than that of the driving shaft 5, the free-rotation control surfaces 35 slid relative to the engagement lugs 31 by overcoming the torsional urging force of the spring 19 so that the driving member 8 starts to rotate a little late behind the turning of the operating handle 18. As a result, the resilient contact between the leading end surfaces of the engagement lugs 31 and the free-rotation control surfaces 35 comes to be cancelled, so that the engagement lugs 31 return between the first restrictive surfaces 33 and the second restrictive surfaces 34 respectively.

When the lead hoisting or the lead traction is carried out after tensioning the lead chain by adjusting a length of the lead chain under the above-mentioned free-rotation control, it becomes possible to return the mechanical brake 13 to the activated state readily by changing over the actuating pawl member 14 from the neutral position to the actuating position, making the forwarding-pawl mesh with the teeth 8*a* of the driving member 8 and swinging the operating lever 16. That is, when the operating lever 16 is swung under such a condition that the forwarding pawl is meshed with the teeth 8*a* of the driving member 8, the driving member 8 rotates in the normal rotation direction, namely in the forwarding direction so as to move back due to screwing effect and activate the mechanical brake 13 because a rotative friction is applied to the driving shaft 5 by the tension of the lead chain. Therefore, it becomes possible to hoist and/or pull the lead by drivingly rotating the lead sheave 3 through the mechanical brake 13.

Though the operating handle 18 is operated for carrying out the free-rotation control during the lead hoisting or the lead traction, the free-rotation control state can not be attained because the forwarding pawl of the actuating pawl member 14 meshes with the teeth 8*a* of the driving member 8.

When the free-rotation control is carried out by pulling out the operating handle 18 after changeover of the actuating pawl member 14 to the neutral position during the load hoisting or the load traction, though the driving member 8 happens to rotate due to the torsional urging force of the spring 19 to release the brake, the mechanical brake 13 comes to effect, similarly to the case in which the load chain is pulled strongly, while the reverse-direction load acting on the load sheave 3 is large. Incidentally, it is preferable that an engagement flange is provided in the inner end portion of the operating handle 18 and an erroneous operation preventive piece is provided in the controlling portion 15 so as to engage with the flange at time of changeover of the actuating pawl member 14 to the forwarding position and the returning position and to make it impossible to carry out the pulling-out operation of the handle 18 and to make it possible to carry out the pulling-out operation only at the time of changeover to the neutral position.

Since the braking action of the mechanical brake 13 can be cancelled to control the load sheave 3 to the free-rotation state by rotating the driving member 8 by a simple operation of merely pulling out the operating handle 18 after changeover of the actuating pawl member 14 to the neutral position, the free-rotation control can be made simple and easy so that the novice operator can carry out the free-rotation control without any erroneous operation and the operability can be improved. Further, since the free-rotation state can be maintained by the axial urging force of the spring 19, when the length of the load chain on the load side is adjusted by pulling it during the free-rotation control, the input range of the traction force can be enlarged, so that also the adjustment of the chain length during the free-rotation control can be carried out without any skill.

In the above-mentioned embodiment, though the engagement lugs 31 are provided in the operating handle 18 and the free-rotation control surfaces 35 are provided in the driving member 8, their provisions may be exchanged to each other. Further, though the flange 25*a* is provided in the first sleeve 25 so as to receive the axial urging force of the spring 19 acting to the operating handle 18 by the flange 25*a* and not to apply the axial urging force to the driving member 8 during a usual use, the flange 25*a* may be omitted.

Next, a second embodiment illustrated in FIGS. 8 through 14 will be explained hereinafter. In this second embodiment there are separately provided a first free-rotation assisting spring 49 for urging the operating handle 18 toward the first position in which it comes near to the driving member 8 and a second free-rotation assisting spring 50 for urging the driving member 8 in the brake releasing direction, with the first spring 49 interposed between the operating handle 18 and the stopper 17 and the second spring 50 interposed between the driving member 8 and the handle 18. Thereupon, when the operating handle 18 is moved to the second position, the driving member 8 is adapted to be urged in the brake releasing direction.

Figure 11:
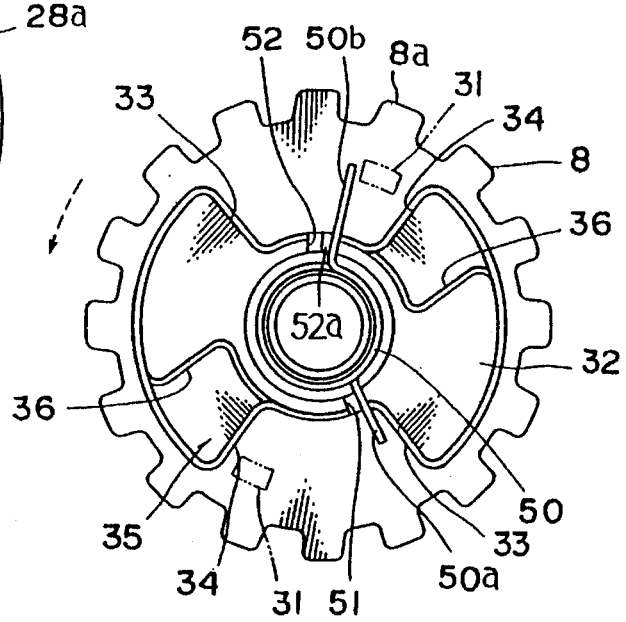
FIG. 11 is a front view showing positional relationships between a driving member, an engagement lug provided in the operating handle and a second spring for assisting the free-rotation during a usual use.
Figure 10:
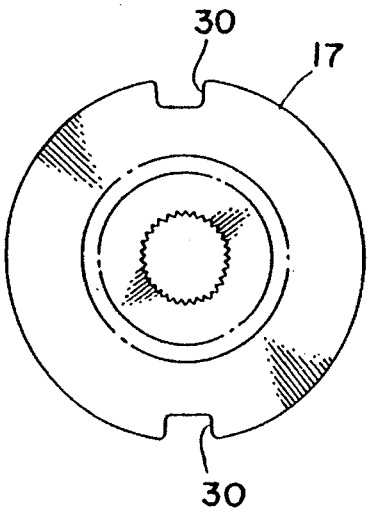
FIG. 10 is a front view of a stopper thereof.
Figure 12:
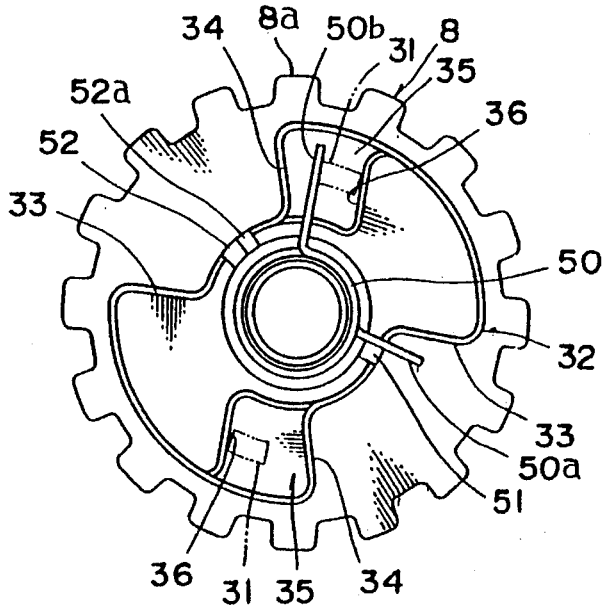
FIG. 12 is a front view showing positional relationships therebetween during a free-rotation control, correspondingly to FIG. 4.
Figure 13:
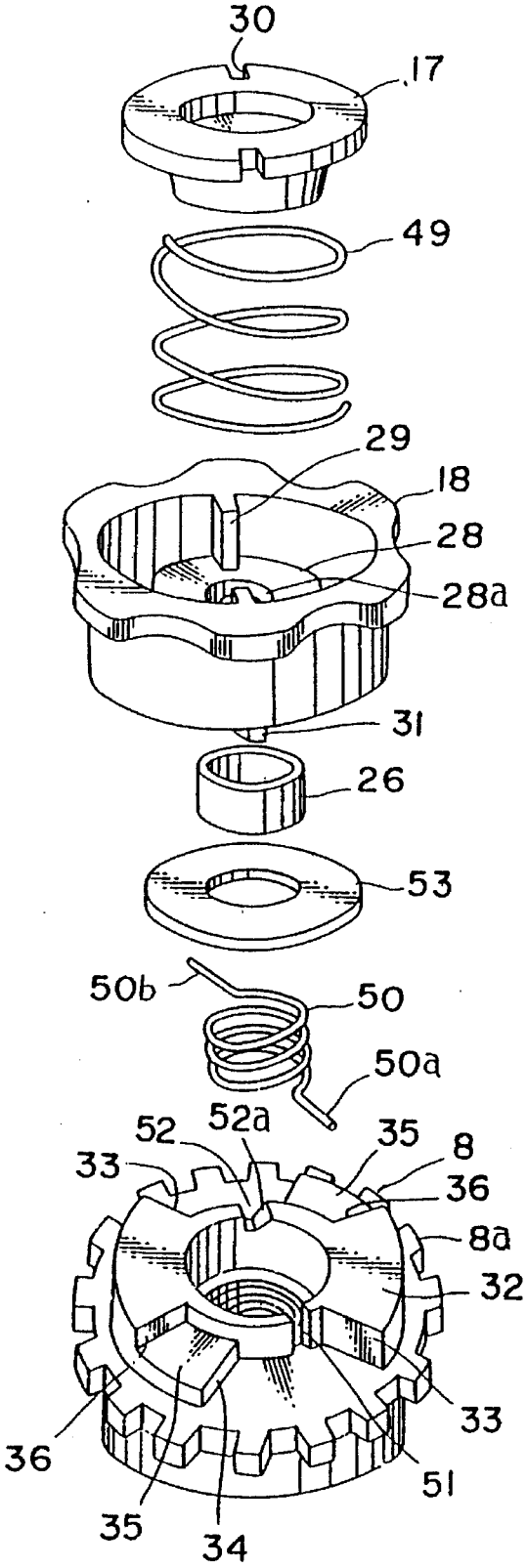
FIG. 13 is a perspective view of a principal portion.

When explaining more in detail, similarly to the free-rotation assisting spring 19 in the first embodiment, the second spring 50 comprises a coil spring with a pair of legs 50*a*, 50*b* and a coil portion of the second spring 50 is internally mounted in a concaved portion of the driving member 8, into which the sleeve 25 was inserted in the first embodiment and is omitted herein so that an axial reaction force can be obtained at the first position of the operating handle 18. As shown in FIGS. 11 through 13, the protruded portion 32 of the driving member 8 is provided with a first and a second engagement portions 51, 52 comprising concaved portions adapted to engage with legs 50*a*, 50*b* of the second spring 50 respectively. The first engagement portion 51 having the so deep concaved portion as to engage with the first spring leg 50*a* after having been pulled out along the outer end surface of the driving member 8. The second engagement portion 52 having the concaved portion which is shallower than that of the first engagement portion 51 and has a wall 52*a* on a side in the brake releasing direction of the driving member 8. The wall 52*a* is so inclined on the brake releasing direction side that the second leg 50*b* can disengage therefrom at the time of rotation in the brake releasing direction. The second spring leg 50*b* is engaged with the second engagement portion 52 so as to generate a torsional reaction force in the coil portion, and thereby the urging against the driving member 8 by the second spring 50 in the brake releasing direction can be interrupted.

The second spring leg 50*b* is extended radially outwards beyond an engagement point of the second engagement portion 52 so as to be able to engage with the engagement lug 31. Accordingly, when the operating handle 18 is pulled out to the second position. the second spring leg 50*b* is returned axially outwards by the axial reaction force of the second spring 50 and disengaged from the second engagement portion 52 by the torsional reaction force at the same time so as to be engaged with the engagement lug 31.

That is, when the engagement with the second engagement portion 52 is cancelled and the second spring leg 50*b* is engaged with the engagement lug 31 of the operating handle 18, the driving member 8 is urged in the brake releasing direction by the torsional reaction force of the second spring 50 based on the handle 18.

Incidentally, at the time of engagement of the second spring leg 50*b* with the second engagement portion 52, there is provided a clearance between the extended portion of the second spring leg 50*b* and the engagement lug 31 as shown in FIG. 11, so that the action of the mechanical brake 13 can be cancelled without deflecting the leg 50*b* at the time of cancellation of the hoisting or traction.

As noted above, according to the second embodiment, while advantageously the free-rotation control can be carried out by a simple operation of merely pulling out the operating handle 18 to the second position similarly to the first embodiment, even though the actuating pawl member 14 of the operating lever 16 is changed over to the neutral position, advantageously the mechanical brake 13 can not happen to be released because the urging force in the brake releasing direction is not applied to the driving member 8 so far as the handle 18 is not pulled out to the second position.

That is, according to the free-rotation function in the second embodiment, similarly to the first embodiment, it becomes possible to rotate the driving member 8 in the brake releasing direction due to the torsional effect of the second spring 50 by merely pulling out the operating handle 18 to the second position after changeover of the actuating pawl member 14 of the operating lever 16 and to release the mechanical brake 13. Further, the engagement lug 31 is brought into resilient contact with the free-rotation control surface 35 by the axial urging force of the first spring 49 at the second position, so that the free-rotation can be maintained. Furthermore, since the second spring 50 is provided separately beside the first spring 49 so as to engage with the second engagement portion 52 of the driving member 8 when the operating handle 18 is located at the first position and to interrupt the urging to the driving member 8 in the brake releasing direction, though the actuating pawl member 14 is changed over to the neutral position, advantageously the driving member 8 never rotates in the brake releasing direction so far as the handle 18 is not pulled out to the second position.

Figure 8:
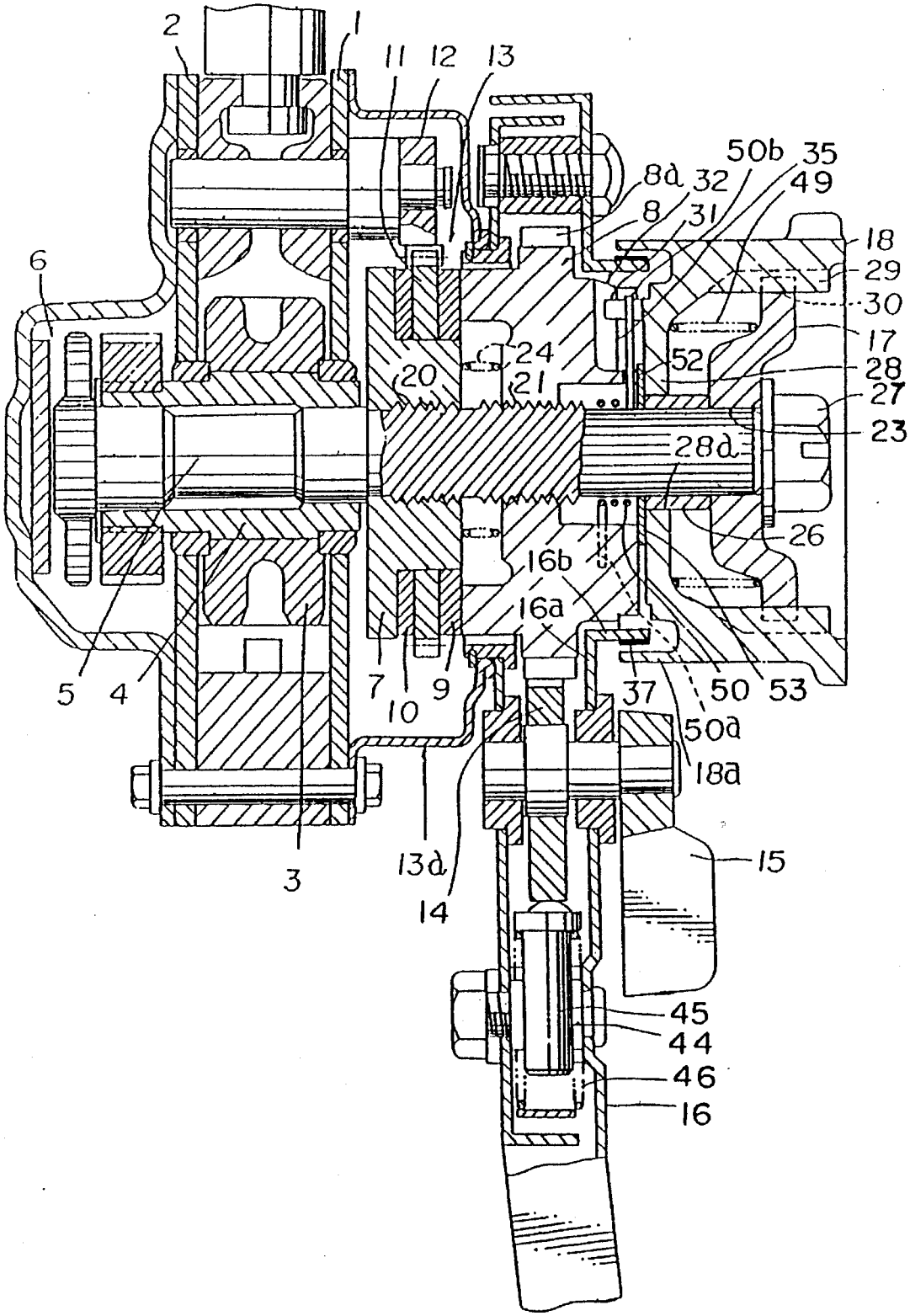
FIG. 8 is a vertical sectional view of the lever-type hoist and traction machine employing a second embodiment of a free-rotation control apparatus of the present invention.
Figure 9:
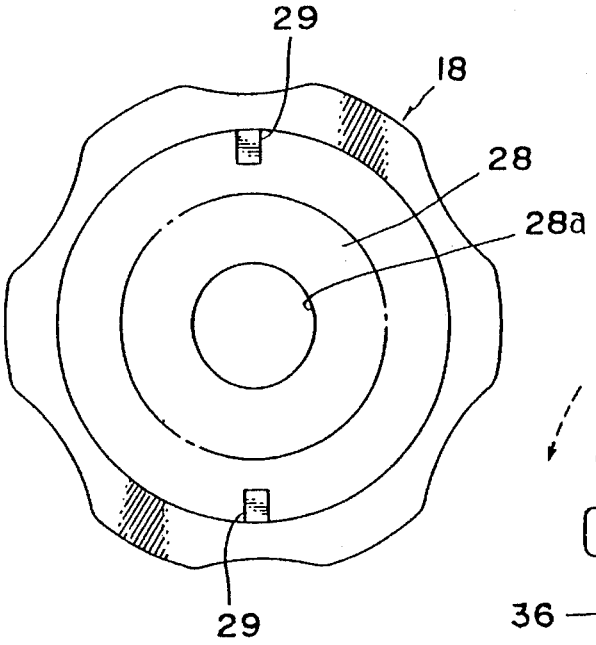
FIG. 9 is a front view of the operating handle thereof.
Figure 14:
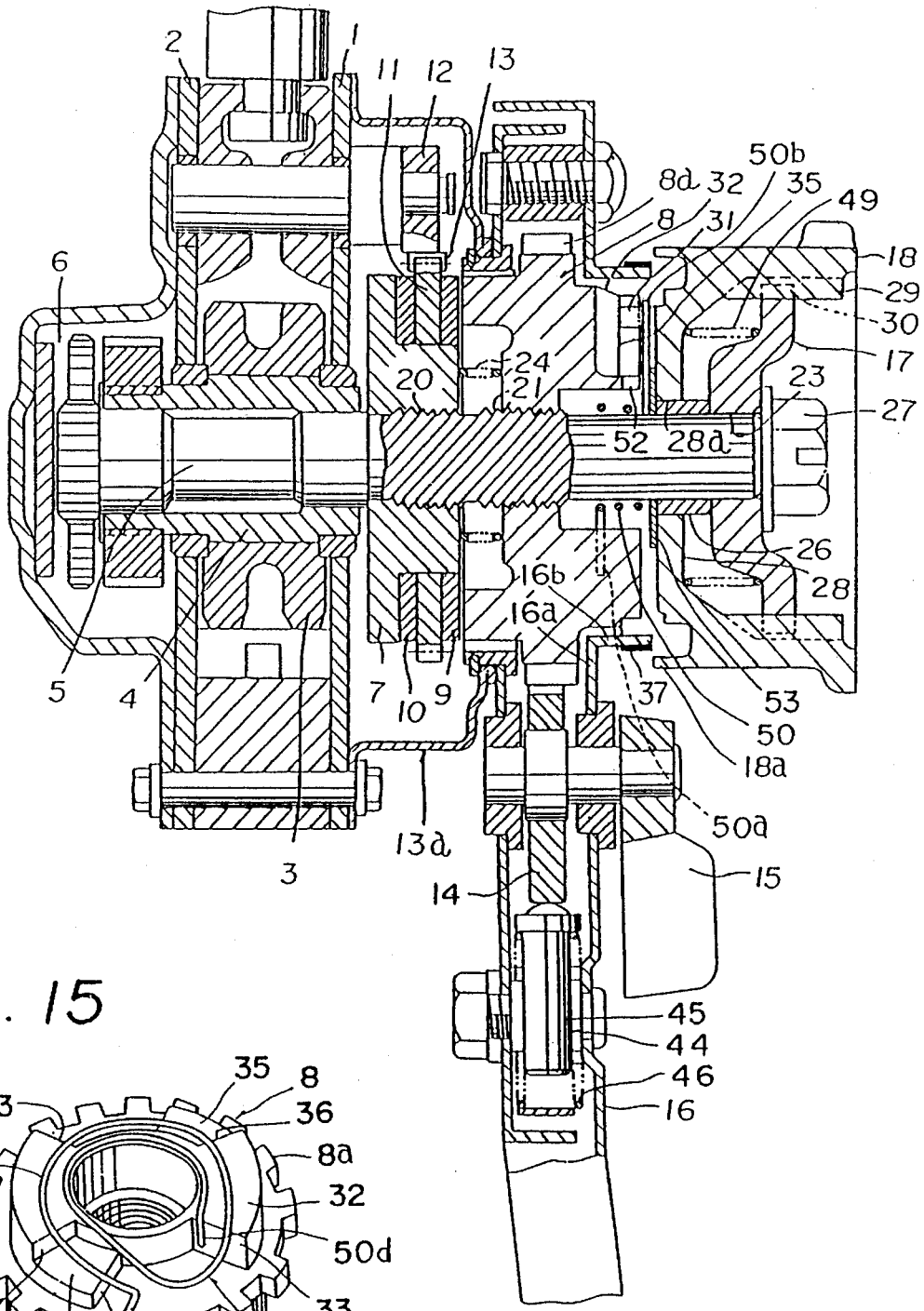
FIG. 14 is a vertical sectional view of the lever-type hoist and traction machine showing the free-rotation control state.

Incidentally, the symbol 53 in FIGS. 8, 13 and 14 designates a spring retaining washer adapted to receive the second spring 50.

Though the second spring leg 50*b* of the second spring 50 is adapted to engage with the engagement lug 31 of the operating handle 18 in the second embodiment, an elongated engagement port for engaging therewith may be formed in the boss portion 28 of the handle 18. When the engagement lug 31 is so utilized as to engage with the second spring leg 50*b*, since it becomes unnecessary to especially provide the elongated engagement port, the construction can be simplified by that portion correspondingly.

Though the above-mentioned embodiments were applied to the lever-type hoist and traction machine, they may be applied to such a hoist and traction machine in which a handle or a hand wheel is used as the driving means.

Figure 15:
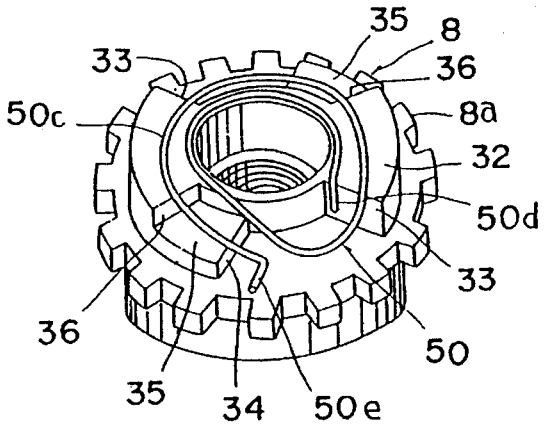
FIG. 15 is a perspective view of another example of the second spring.

Further, though the driving member 8 had the teeth 8*a* formed integrally in its outer periphery, it may be constructed by a brake pusher adapted to be threadably mounted to the driving shaft 5 and a rotor supported rotatably by a tubular portion of the brake pusher and provided with outer peripheral teeth. The overload preventive mechanism may be then assembled between the brake pusher and the rotor and the spring legs of the spring 19 or 50 may be engaged with the brake pusher or a transmission torque regulating member adapted to be threadably mounted to the tubular portion of the brake pusher. When the first spring 49 and the second spring 50 are provided separately in this construction like the second embodiment, the second spring 50 may comprise the torsional portion 50*c* twisted spirally to lie in a single plane as illustrated in FIG. 15 and the first and the second spring legs 50*d*, 50*e*. In case that the first spring leg 50*d* is bent to the axial direction, namely perpendicularly to the torsional portion 50*c* and the first restrictive surface 33 of the driving member 8 or the overload preventive mechanism (not illustrated) are assembled therein, the leg 50*d* is made to engage with the first restrictive surface 33 provided in the transmission torque regulating member and the second spring leg 50*e* is made to engage with the engagement lug 31 of the operating handle 18 after having been bent in the radial direction relative to the torsional portion 50*c*.

In this case, the second spring leg 50*e* is made to engage with the engagement lug 31 regardless of the position of the operating handle 18, namely of course in the second position and also in the first position, so that the torsional urging force of the second spring 50 can be always applied to the driving member 8. The spring leg, which is directly engaged with the driving member 8, may alternatively be indirectly engaged with the driving member 8 through another member adapted to rotate as one piece.

Though the engagement lug 31 of the operating handle 18 was made to be directly in resilient contact with the free-rotation control surface 35 of the driving member 8 by the axial urging force of the spring 19 or 49 during the free-rotation control, it may be brought into resilient contact with the transmission torque regulating member adapted to be threadably mounted to the tubular portion of the brake pusher in the case that the overload preventive mechanism is provided. The engagement lug 31, which is brought into resilient contact with the regulating member, may alternatively be brought into resilient contact with another member adapted to rotate together with the brake pusher as one piece. Further, in case that the operating handle 18 is brought into resilient contact with the torque transmission member or another member, these members are provided with the restrictive means.

ADVANTAGES OF THE INVENTION

Since there is provided the free-rotation assisting spring 19, which urges the operating handle 18 toward the first position in which the handle 18 is near to the driving member 8 and urges the driving member 8 in the brake releasing direction, when the handle 18 is pulled out to the second position so as to carry out the free-rotation, the driving member 8 can be rotated in the brake releasing direction with respect to the driving shaft 5 by a torsional urging force of the spring 19 in the brake releasing direction to make the mechanical brake release. Thereupon, the operating handle 18 can be brought into resilient contact with the driving member 8 by an axial urging force of the spring 19 toward the first position to maintain the free-rotation operation by the handle 18. Therefore, it becomes possible to enlarge an input range of a pulling force of the load chain due to the maintaining of the free-rotation state by the spring 19 at the time of free-rotation control. As a result, a length of the load chain can be adjusted without requiring any skill. Further, when the operating handle 18 has been pulled out to the second position, since the mechanical brake can be released by rotating the driving member 8 due to an effect of the spring 19, the free-rotation operation can be carried out by merely pulling out the handle 18 even though a novice operator carries out the free-rotation control. Accordingly, an operability can be made simple and easy and erroneous operations can be avoided so as to improve the operability and dissolve such an inconvenience that the free-rotation control becomes impossible due to such erroneous operations.

Since there is provided the second spring 50 besides the first spring 49, these first and second springs 49, 50 can be mounted separately respectively. Therefore, since their mountabilities can be improved in comparison with a case in which one spring serves a double purpose. Also, a spring characteristic can be selected according to a function of each spring 49, 50, so that the effects mentioned in the invention of claim 1 can be accomplished more effectively.

Since the second spring 50 is adapted to engage with the engagement lug 31, the urging control for the second spring 50 becomes possible due to a simple construction employing the engagement lug 31.

The second spring 50 can be formed in a flat configuration. Therefore, the second spring 50 can be mounted even to a small space between the driving member 8 and the operating handle 18 and can be applied also to such a machine as to have an overload preventive mechanism.

Since the driving member 8 is provided with the engagement portion 52, when the operating handle 18 is located at the first position, the first spring 50 is engaged with the engagement portion 52 of the driving member 8 so that the driving member 8 is not urged in the brake releasing direction while when the handle 18 is moved to the second position, the engagement by the engagement portion 52 is cancelled so as to urge the driving member 8 in the brake releasing direction. Therefore, in addition to the functions noted above it becomes also possible to avoid a sudden release of the mechanical brake 13 due to an action of the second spring 50 at the time of hoist and traction working carried out at the first position of the handle 18. That is, even though the actuating pawl member of the operating lever provided as the driving means is misoperated to a neutral position in the lever-type hoist and traction machine, the sudden release of the mechanical brake 13 can be prevented.

In the lever-type hoist and traction machine, since the spring force for urging the driving member 8 in the brake releasing direction is used as such a spring force capable of rotating the driving member 8, disengaged from the actuating pawl member 14 of the operation lever 16, to the brake released position when the operating handle 18 has been pulled out to the second position, the free-rotation operation can be carried out by merely pulling out the handle 18 under such a condition that the actuating pawl member 14 of the operating lever 16 is set to the neutral position, namely the free-rotation position. Accordingly, it becomes unnecessary to carry out tedious operations such as rotating the handle 18 and returning the returning pawl of the actuating pawl member 14 to the neutral position after having been made to engage with the driving member, so that the operability can be made simple and easy and the free-rotation position of the actuating pawl member 14 can be indicated. Further, since the free-rotation operation can be carried out by merely pulling out the handle 18, erroneous operations of not only the handle 18 but also the actuating pawl member 14 can be avoided so as to improve the operabilities. Furthermore, since the brake is released by rotating the driving member 8 relative to the driving shaft 5 by the spring force, the spring force can be made less than that required for rotating the driving shaft 5. Therefore, the return from the free-rotation state to the steady state in which the braking is effected can be performed smoothly.

Further, when the free-rotation control is carried out after the operating handle 18 has been moved to the second position, a cylindrical cover portion **18*a* provided in the handle 18 is moved following the movement of the handle 18, so that a free-rotation indicating portion 37 provided on a protruded tube 16*b* of the operating lever 16 appears for indication. Therefore, it can be readily recognized from outside that the operating handle 18 is located at the second position so that the load sheave 3 is under the controllable condition of the free-rotation. When the free-rotation indicating portion 37 is covered by the cylindrical cover portion 18*a* of the handle 18 not to be observed from outside, it can be readily recognized that the handle 18 is located at the first position and the load sheave 3** is in the steady operating state. Accordingly, it becomes possible to avoid erroneous operations of operators.

Additional advantages and modifications will readily occur to those skilled in the art. The invention in its broader aspect is, therefore, not limited to the specific details, respective machines and illustrative examples shown and described. Accordingly, departures may be made from such details without departing from the spirit or scope of the applicants' general inventive concept.

What is claimed is:

1. A free-rotation control apparatus of a hoist and traction machine including a load sheave, a driving shaft which has a driven member and serves to drive the load sheave, a driving member threadably mounted to the driving shaft, a mechanical brake interposed between the driving member and the driven member and driving means for driving the driving member in the normal and reverse rotation directions, said free-rotation control apparatus enabling the load sheave to rotate freely by inactivating the mechanical brake and comprising:

a) a stopper disposed at an axial end portion of the driving shaft;

b) an operating handle interposed between the stopper and the driving member so as to be axially movable between a first position in which it comes near to the driving member and a second position in which it is spaced apart therefrom and non-rotatable relative to the driving shaft;

c) a free-rotation assisting spring interposed between the stopper and the driving member and serving to urge the operating handle toward the first position in which the handle comes near to the driving member, to urge the driving member in a brake release direction and to release the brake by rotating the driving member when the operating handle is set to the second position;

d) restrictive means interposed between the operating handle and the driving member and for restricting a relative rotation range of the driving member with respect to the driving shaft when the operating handle is located at the first position and cancelling the restriction when the handle is located at the second position; and e) free-rotation maintaining means for bringing the operating handle into resilient contact with the driving member by an axial urging force of the spring so as to maintain the free-rotation operation carried out by the operating handle when the handle is located at the second position.

2. A free-rotation control apparatus of a hoist and traction machine as set forth in claim 1, wherein the driving means comprises an operating lever provided with an actuating pawl member for engaging disengagably with the driving member, and a spring force for urging the driving member in the brake releasing direction can be used as a spring force for rotating the driving member disengaged from the pawl member of the operating lever, to the brake releasing position when the operating handle is moved to the second position.

3. A free-rotation control apparatus of a hoist and traction machine as set forth in claim 1, wherein the driving means comprises an operating lever provided with an actuating pawl member for engaging disengagably with the driving member, the operating lever has a boss portion provided with a protruded tube projecting toward the operating handle, the operating handle is provided with a cylindrical cover portion which covers the protruded tube, and the protruded tube is provided with a free-rotation indicating portion which appears for indication by the movement of the cover portion when the operating handle has been moved to the second position.

4. A free-rotation control apparatus of a hoist and traction machine including a load sheave, a driving shaft which has a driven member and serves to drive the load sheave, a driving member threadably mounted to the driving shaft, a mechanical brake interposed between the driving member and the driven member and driving means for driving the driving member in the normal and reverse rotation directions, said free-rotation control apparatus enabling the load sheave to rotate freely by inactivating the mechanical brake and comprising:

a) a stopper disposed at an axial end portion of the driving shaft;

b) an operating handle interposed between the stopper and the driving member so as to be axially movable between a first position in which it comes near to the driving member and a second position in which it is spaced apart therefrom and non-rotatable relative to the driving shaft;

c) a first free-rotation assisting spring interposed between the stopper and the operating handle and serving to urge the operating handle toward the first position in which the handle comes near to the driving member;

d) restrictive means interposed between the operating handle and the driving member and for restricting a relative rotation range of the driving member with respect to the driving shaft when the operating handle is located at the first position and cancelling the restriction when the handle is located at the second position;

e) free-rotation maintaining means for bringing the operating handle into resilient contact with the driving member by an axial urging force of the first spring so as to maintain the free-rotation operation carried out by the operating handle when the handle is located at the second position; and f) a second free-rotation assisting spring interposed between the driving member and the operating handle so as to urge the driving member in the brake releasing direction.

5. A free-rotation control apparatus of a hoist and traction machine as set forth in claim 4, wherein a free-rotation control surface is formed in such a surface of the driving member as to be opposed to the operating handle side while an engagement lug is protruded from such a surface of the operating handle as to be opposed to the driving member side so as to be brought into resilient contact with the free-rotation control surface by the urging force of the first spring when the operating handle is located in the second position, and the second free-rotation assisting spring for urging the driving member in the brake releasing direction is engaged with the engagement lug.

6. A free-rotation control apparatus of a hoist and traction machine as set forth in claim 5, wherein the second spring comprises a coil portion twisted torsionally to lie in a single plane, a first spring leg located at one end of the coil portion so as to engage with the driving member and a second spring leg located at the other end thereof so as to engage with the engagement lug of the operating handle.

7. A free-rotation control apparatus of a hoist and traction machine as set forth in claim 4, wherein the driving member is provided with an engagement portion which engages with the second spring so as to interrupt that the second spring urges the driving member in the brake releasing direction when the operating handle is located at the first position, and which cancels the engagement with the second spring when the operating handle is moved to the second position.

* * * * *